US007901328B1

(12) United States Patent
Kessler et al.

(10) Patent No.: US 7,901,328 B1
(45) Date of Patent: Mar. 8, 2011

(54) GYMNASTIC TRAINER ASSEMBLY

(75) Inventors: Mark T. Kessler, Northumberland, PA (US); Timothy M. Bowers, Turbotville, PA (US)

(73) Assignee: Resilite Sports Products, Inc., Northumberland, PA (US)

( * ) Notice: Subject to any disclaimer, the term of this patent is extended or adjusted under 35 U.S.C. 154(b) by 0 days.

(21) Appl. No.: 12/788,782

(22) Filed: May 27, 2010

Related U.S. Application Data

(60) Provisional application No. 61/219,499, filed on Jun. 23, 2009.

(51) Int. Cl.
*A63B 21/00* (2006.01)

(52) U.S. Cl. ..... 482/35; 482/142; 482/130

(58) Field of Classification Search ..... 482/35, 482/142, 130, 907; 297/423.41, 452.41; 5/652, 630, 632, 655.9, 655.3; D21/686
See application file for complete search history.

(56) References Cited

U.S. PATENT DOCUMENTS 3,628,790 A * 12/1971 Gordon ..... 482/15
4,109,960 A 8/1978 Stinchfield
4,969,222 A * 11/1990 Serola ..... 5/630
6,575,885 B1 * 6/2003 Weck et al. ..... 482/147
D523,494 S * 6/2006 Van Straaten ..... D21/686
7,186,206 B2 3/2007 Wren
7,789,805 B2 * 9/2010 Lim ..... 482/35
2008/0096740 A1 * 4/2008 Nichols ..... 482/121
2010/0184567 A1 7/2010 Lim

FOREIGN PATENT DOCUMENTS

DE 29913163 U1 11/1999

OTHER PUBLICATIONS

Three (3) photographs of front of gymnastic handspring training apparatus, U.S. Sep. 30, 2008.
Series of twelve still photographs illustrating a handspring performed using a gymnastic training apparatus, U.S. Sep. 30, 2008.
Resilite Sports Products, Inc., Gymnastic & Cheer Mats & Training Aids 2008/2009 Product Catalog and order form, 28 pages, U.S., Aug. 31, 2007.

* cited by examiner

*Primary Examiner* — Jerome Donnelly
(74) *Attorney, Agent, or Firm* — Hooker & Habib, P.C.

(57) ABSTRACT

A tumbling and vaulting trainer assembly configurable for performing either tumbling or vaulting routines. The assembly includes a pivoting trainer for tumbling routines and a chock used in with the pivoting trainer portion for vaulting routines.

18 Claims, 4 Drawing Sheets

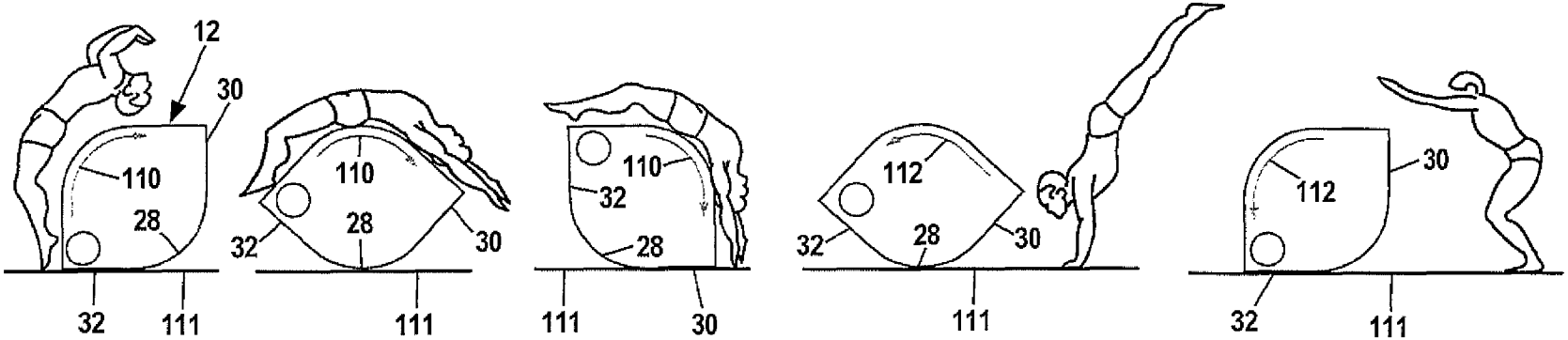
Fig. 6
Fig. 7
Fig. 8
Fig. 9
Fig. 10
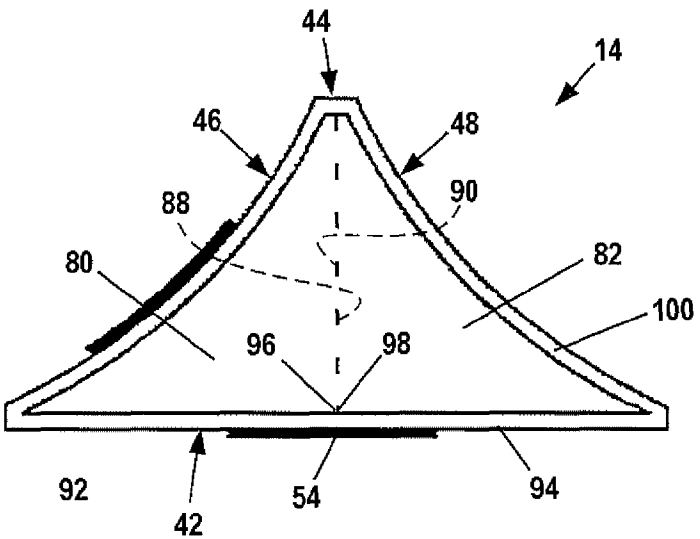
Fig. 12
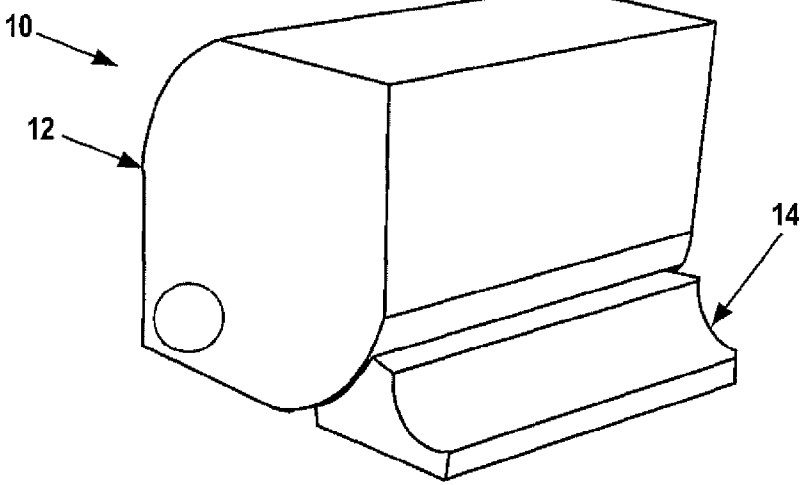
Fig. 11

GYMNASTIC TRAINER ASSEMBLY

This application claims priority to our provisional patent application filed Jun. 23, 2009, No. 61/219,499.

FIELD OF THE INVENTION

The invention is related to training equipment for gymnastic tumbling and vaulting.

BACKGROUND OF THE INVENTION

Gymnastics, cheerleading and other sports involve tumbling and vaulting. Participants must be taught to perform forward and backward handsprings, forward and backward walkovers, and vaults over obstacles.

Teaching students to perform tumbling and vaulting routines requires coaching and use of specialized, single-function training equipment. In order to master gymnastic routines, the students repeatedly perform the routines using the training equipment with assistance of a coach.

Conventional tumbling equipment includes a trainer that rotates along a gymnasium floor. The student jumps against the trainer to rotate the trainer and use its rotary motion to assist in performing a tumbling routine. A coach monitors and adjusts the position of the trainer during student use. The coach must manually reset the trainer to a starting position after each use. The trainer may be cylindrical, polygonal in cross-section. A generally rhombic trainer returns to the start position automatically but rocks back and forth after each student use.

Fundamental vaulting skills are not easily taught using conventional tumbling training equipment. A conventional tumbling trainer cannot be used to teach a student to propel his or her body horizontally in the direction of a handspring or walkover vault with limited upward motion.

Tumbling and vaulting training equipment is bulky. Storage of this equipment requires dedicated storage space. Conventional vaulting training equipment is heavy and difficult to move.

There is a need for a portable tumbling and vaulting trainer assembly that can be used to teach students both tumbling and vaulting routines. The assembly should require minimal adjustment by a coach during use, assist the student in learning correct tumbling and vaulting skills, be easy to move as required, and be easily converted between use for tumbling training and use for vaulting training.

SUMMARY OF THE INVENTION

The invention is a portable gymnastic trainer assembly including a pivot trainer and a chock that assists training students to perform both tumbling and vaulting routines. The shape of the trainer and weights placed in the trainer force the student to use correct form while performing tumbling routines. After the student completes a tumbling routine, the weights automatically pivot the trainer back to its start position without rocking for use in performing another routine. The trainer requires minimal adjustment by a coach during use.

For vaulting training, the pivot trainer and a chock are removably mounted on a gymnastic floor surface, which may be looped carpet, so that the pivot trainer is supported against movement. The supported trainer teaches fundamental vaulting skills by forcing students to propel their bodies over the trainer with use of hands in contact with the top surface of the trainer during the upward motion. The chock prevents pivoting of the trainer during vaulting routines.

The trainer and chock are made from a single rectangular block of resilient foam material to reduce cost. The assembly is light and easy to move and consumes much less storage space than single-purpose conventional tumbling trainers and vaulting trainers.

Other objects and features of the invention will become apparent as the description proceeds, especially when taken in conjunction with the accompanying drawings illustrating the invention.

DESCRIPTION OF THE DRAWINGS

FIGS. 6 through 10 show use of the pivoting trainer for tumbling training;

FIG. 11 is a perspective view of the trainer and chock in position for vaulting training;

FIG. 12 is a side view of an assembly chock;

DETAILED DESCRIPTION OF THE INVENTION

Figure 1:
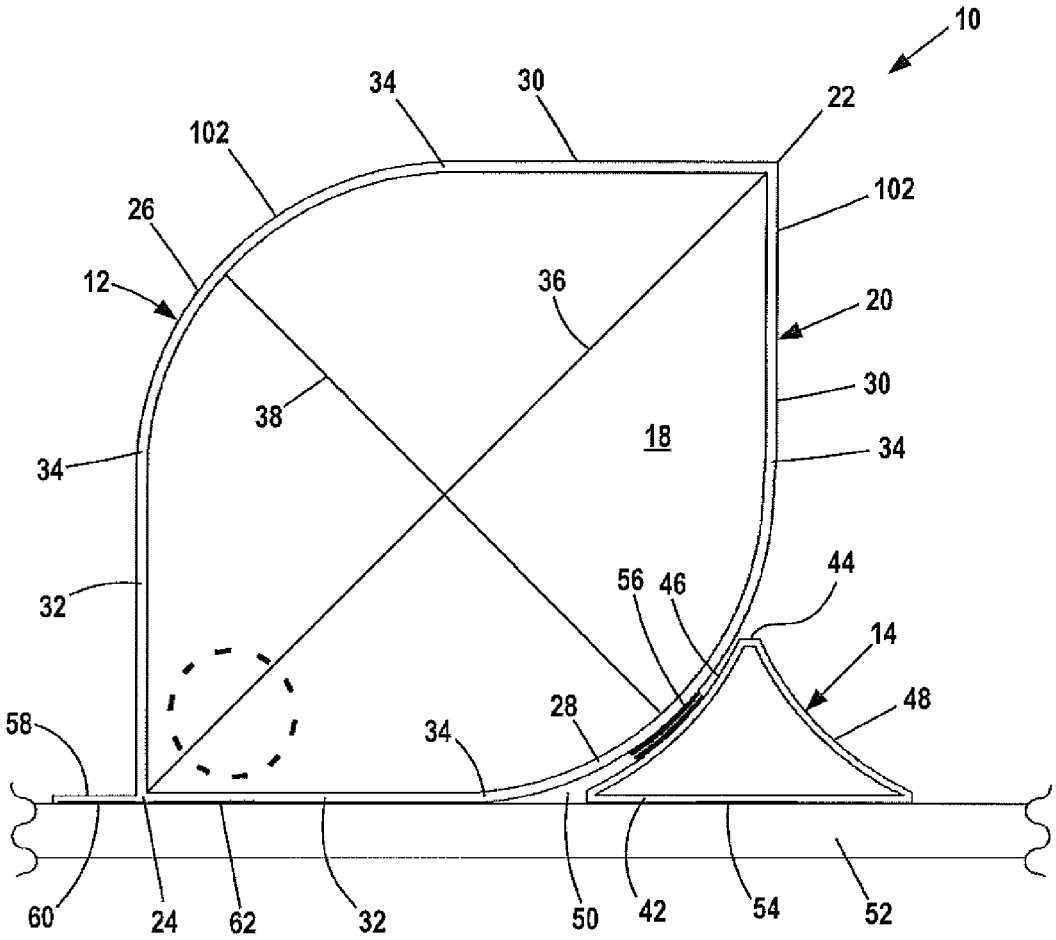
FIG. 1 is a side view of the gymnastic trainer assembly.

Gymnastic trainer assembly 10 is a training aid for gymnastics, cheerleading and other sports involving tumbling, vaulting, handsprings and the like. Assembly 10 includes a pivot trainer 12 and a chock 14, which can be removably mounted on a gymnastic carpet or floor.

Pivot trainer 12 has opposed, flat and parallel sides 16 and 18 and a circumferential surface 20 extending around the trainer between the sides. The trainer has a uniform cross-section in planes parallel to sides 16 and 18. Circumferential surface 20 extends perpendicularly to the sides.

Surface 20 has two opposed right angle corners 22 and 24 and two opposed rounded corners 26 and 28 each located between corners 22 and 24. Perpendicular flat walls 30 intersect at corner 22. Perpendicular flat walls 32 intersect at corner 24. Horizontal wall 30 is on the top of the trainer. Horizontal wall 32 is on the bottom of the trainer. Vertical wall 30 is on the front of the trainer. Vertical wall 32 is on the back of the trainer. The walls 30 and 32 extend from their respective corners and join the ends of the adjacent rounded corners 26 and 28 at four junctions 34. The corners 22 and 24, rounded corners 26 and 28, and walls 30 and 32 extend between sides 16 and 18.

The trainer 12 is symmetrical to either side of plane 36 extending between corners 22 and 24. The trainer is also symmetrical to either side of plane 38 extending between the centers of rounded corners 26 and 28. As illustrated in FIG. 1, the vertical cross-section of trainer 12 is rectangular with the exception of rounded corners 26 and 28. These corners are preferably partially cylindrical with a radius which is one-half the horizontal width of the trainer, the horizontal distance between walls 30 and 32.

Chock 14 has a uniform, generally triangular vertical cross-section and a length equal to the distance between the trainer sides 16 and 18. The chock has a base 42, a top 44 and angled, concave sides 46 and 48 extending upwardly from the ends of the base to the top. Side 46 conforms to the outer surface of trainer rounded corner 28. The chock 14 is positioned in recess 50 between support surface 52 for trainer 12 and trainer rounded corner 28 to hold the trainer in place. Support surface 52 may be a looped gymnastic carpet of the type typically used to support gymnastic equipment when performing training exercises. Other types of support surfaces may be used. An advantage of a looped carpet is that a hook Velcro-type fastener member can be readily attached to the carpet at a desired location. The hooked Velcro-type member is also readily removed from the looped carpet. Other types of support surfaces are contemplated. Looped Velcro-type fastening members may be attached to these surfaces to facilitate mounting the trainer and chock on the surfaces and removing the trainer and chock from the surfaces.

The chock is removably mounted on carpet support surface 52 by a make-and-break fabric hook fastener 54 on chock base 42. Fastener 56 holds chock side 46 to trainer 12 at corner 28 and includes a loop fastener member secured to rounded corner 28 of trainer 12 and a complementary hook fastener member on side 46 of chock 14.

The pivot trainer 12 includes a flexible vinyl fabric flap 58 at corner 24. Flap 58 extends between trainer sides 16 and 18. When the trainer is mounted on carpet 52 for vaulting, flap 58 overlies the carpet outwardly from the corner 24. The trainer is removably secured to the carpet by make-and-break fabric hook fastener 60 on flap 58. Loop fastener 62 on wall 32 adjacent corner 24 holds the flap on the trainer during tumbling.

When vault training drills are completed, the trainer can be easily used for tumbling exercises. The trainer is removed from the carpet 52 by separating the connections formed by fasteners 56 and 60. The chock is removed from the carpet. The flap 58 is folded under trainer corner 24 so that the hook fastener member on the flap engages the loop fastener member 62.

All fasteners extend across the width of the trainer, chock or flap, between sides 16 and 18. The fasteners are formed from engageable and disengageable or make-and-break fabric members which may be Velcro-type hook or loop fabric members sewn or secured to the adjacent surfaces of the trainer, chock and carpet. Fasteners 54, 56 and 60 hold the trainer and chock in place on carpet surface 52 during vaulting training. Fasteners 60 and 62 hold the flap on the bottom of the trainer so that fastener 60 does not engage the carpet when the trainer is rotated on surface 52 during tumbling training.

When the assembly is used to teach vaults, the trainer and chock are secured to carpet 52 as shown in FIG. 1. Side 46 of the chock engages the trainer corner 28 to prevent rotation of trainer 12. Make-and-break connections secure the trainer to the chock and to the carpet. Chock side 46 need not be concave or have a shape complementary to the shape of trainer rounded corner 28. The side of the chock engaging the trainer may have any shape as desired, so long as the chock extends upwardly above the top of the carpet to engage corner 28 and prevent rotation of the trainer.

Different size trainers 12 are required for training different size students. Taller students require larger trainers. Smaller students require smaller trainers. The requirements of most students are met by trainers having a width between sides 16 and 18 of 36 inches and a height of 26 inches, a length between walls 30 and 32 of 36 inches and a height-to-length ratio of 0.72; or a height of 30 inches, a length of 36 inches and a height-to-length ratio of 0.83; or a height of 35 inches, a length of 36 inches and a height-to-length ratio of 0.97; or a height of 40 inches, a length of 36 inches and a height-to-length ratio of 1.11.

Figure 16:
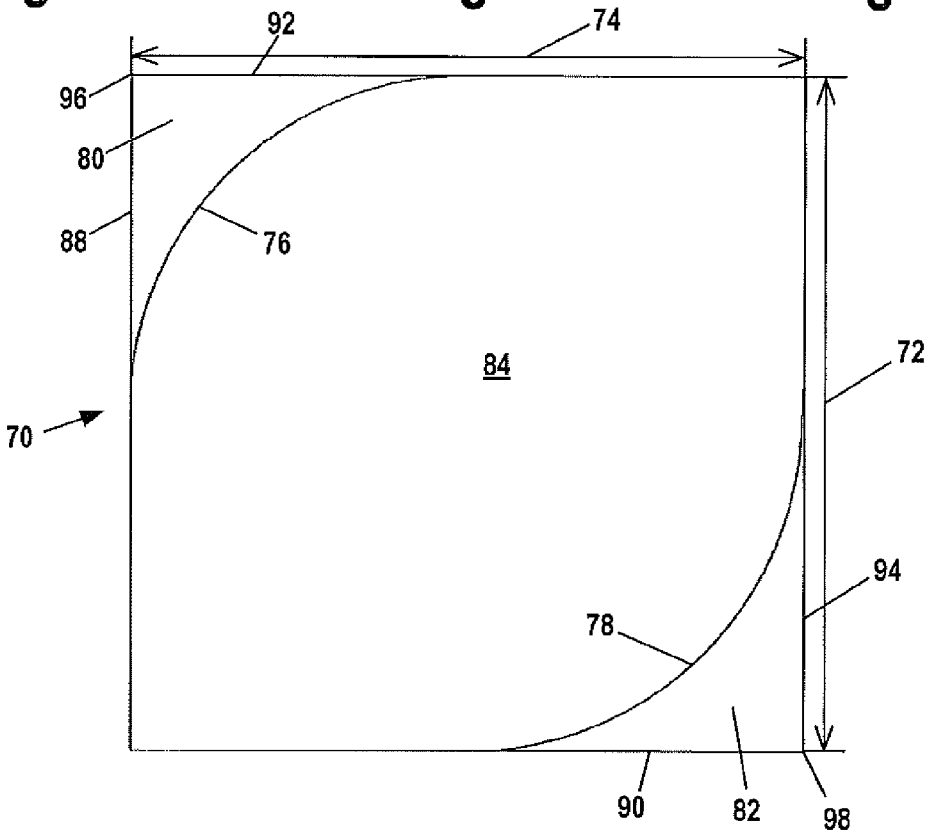
FIG. 16 is a side view of a rectangular block of foam material used to manufacture a rotary trainer and chock.

Pivot trainer 12 and chock 14 each include a stiffly resilient polyurethane foam core surrounded by a vinyl fabric covering. FIG. 16 illustrates a rectangular block 70 of polyurethane foam used in the manufacture of trainer 12 and chock 14. The block 70 has a width between opposed sides 16 and 18 of 36 inches and a height 72 and length 74 as required for the desired trainer. Semi-cylindrical arcuate cuts 76 and 78 are formed through the width of the block at diagonally opposed corners of the block to form opposed trainer rounded corners 26 and 28 and separate chock sections 80 and 82. The remainder of block 70 forms foam trainer core 84.

Figure 2:
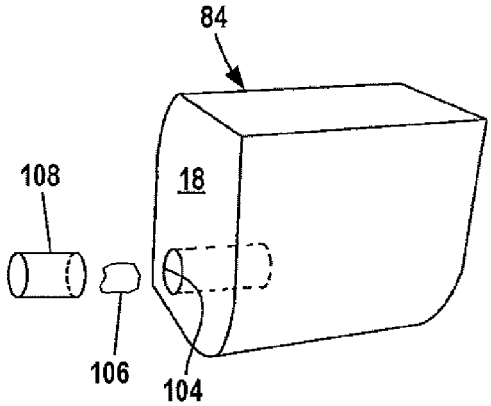
FIGS. 2 and 3 are perspective views illustrating placement of weights into cavities in a pivoting trainer core.
Figure 3:
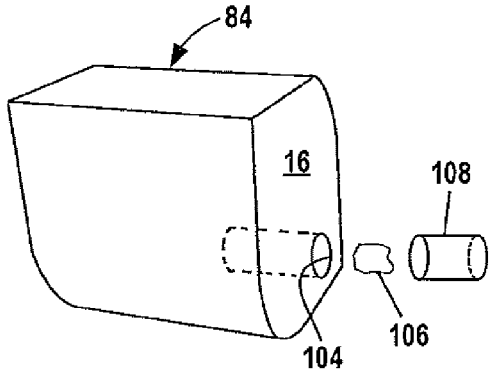
Figure 4:
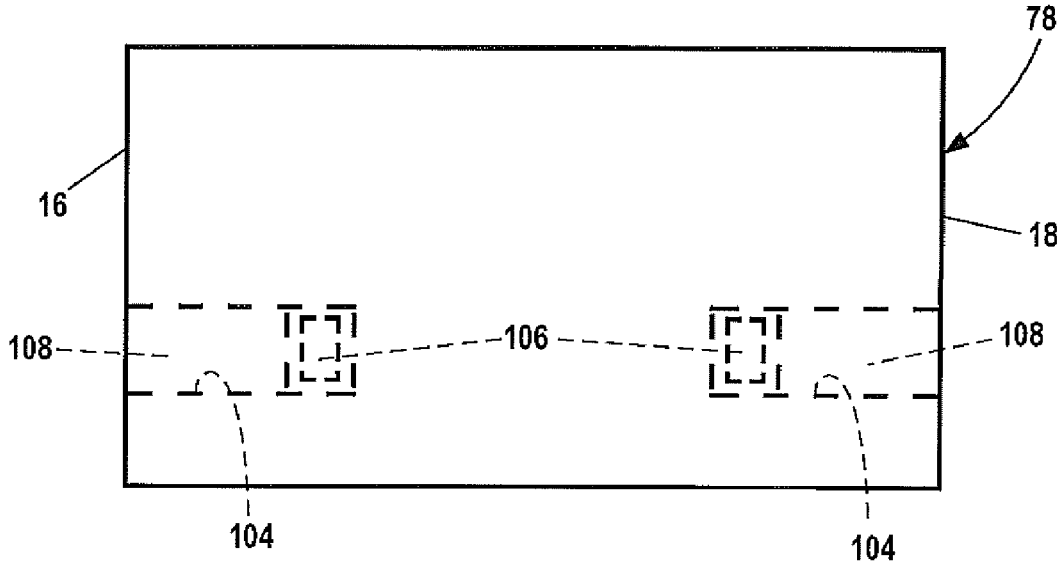
FIG. 4 is a top view of the pivoting trainer core.

After manufacture of trainer core 86, as previously described, counterbalance weights are inserted into the core at corner 24 from each core side 16, 18, as shown in FIGS. 2, 3 and 4. A weight recess 104, is formed in each side 16 and 18 inwardly a short distance from right angle corner 24. The formed core 108 is removed. A weight 106, which may be a bag filled with sand, a bag of heavy metal pellets or other heavy material, is placed in the bottom of each bore and the foam core 108 is inserted to close the bore and hold the weight in place in core 86. After the weights have been inserted into the core, vinyl fabric cover 102 is attached to the core. The cover overlies the bores and cores 108. Flap 58 is attached to cover 102.

While two weights 106 are shown, other weight arrangements are contemplated, including a single weight located equidistant from between sides 16 and 18 and a long weight extending between the sides.

FIGS. 2, 3 and 4 show installation of weights 106 into cavities 104 located on either side of core 84. The amount of weight installed into the cavities can be altered to increase or decrease the force required to smoothly rotate trainer 12 back to the set position after a tumbling routine.

The generally-triangular chock sections 80 and 82 are joined together to form a foam core 86 for chock 14. The sections 80 and 82 are positioned adjacent each other, as shown in FIG. 12, with sides 88 and 90 abutting and bonded to each other, sides 92 and 94 lying in a plane at the base of the chock and corners 96 and 98 adjacent each other at the base. The sharp outer edges of foam section 80 and 82 are trimmed away. Chock core 86 is covered by vinyl fabric 100. The described flexible fabric fastening members are secured to the trainer chock, typically by sewing.

Use of assembly 10 will now be described.

Figure 5:
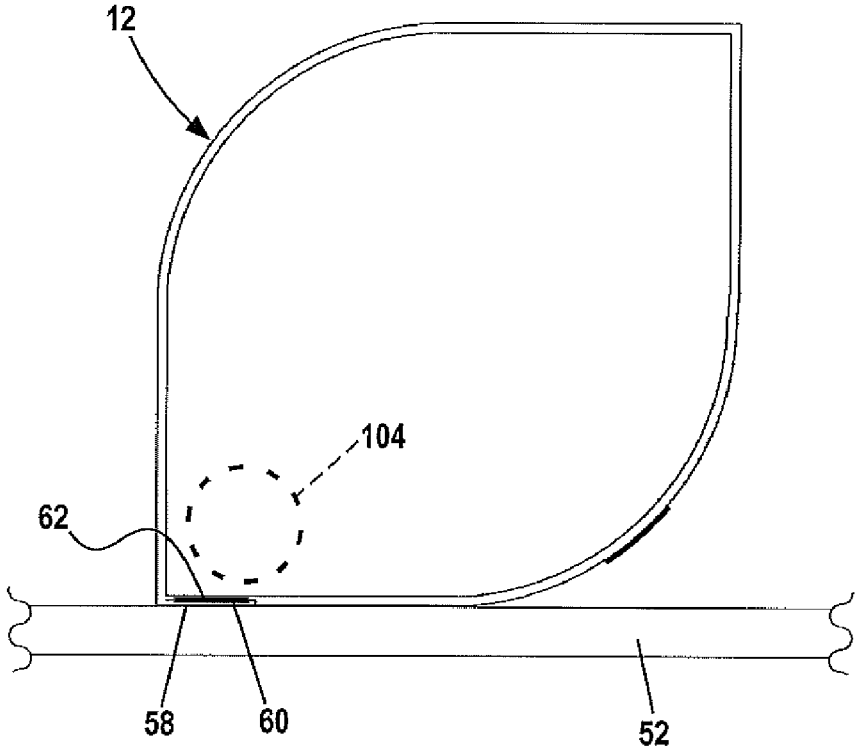
FIG. 5 is a side view of the pivoting trainer on a support surface in position for tumbling training.

Pivoting trainer 12 may be used without chock 14 to train a user to perform handsprings, walkovers and other tumbling exercises. FIGS. 6 through 10 illustrate use of trainer to perform a back handspring. First, a student places trainer 12 on to a gymnastic support carpet 52. The student or coach assures flap 58 is folded under the trainer so that the flap is held against the trainer while the trainer is rotated on the carpet. See FIG. 5.

Trainer 12 rests on carpet 52. A student approaches trainer 12 and places his or her back against the adjacent vertical wall 32 and corner 26. The student exerts a force against trainer 12 to rotate the trainer in the direction of arrow 110 as shown in FIG. 6. Trainer 12 rotates along surface 111 and the student moves with the trainer until side wall 30 comes in contact with the surface, as shown in FIG. 8. At this point, the student moves free from the trainer to complete the handspring. Weights 106 exert a force to counter rotate the trainer in the direction of arrow 112 back to its original position as shown in FIGS. 9 and 10. The weights 105 smoothly counter rotate the trainer back to the start position of FIG. 6 without rocking at the return position.

FIGS. 6 through 10 show use of trainer 12 to train for a back handspring. The trainer may be used to train for a front handspring. The student faces the trainer 12 and rotates the trainer as described. The trainer may also be used to train for a back walkover or front walkover. In each case, the weights 106 automatically counter rotate the trainer back to the start position.

Weights 106 shift the center of gravity of the trainer toward corner 24. When the assembly is at the start position, shown in FIGS. 5 and 6, the center of gravity is above bottom flat wall 32 and the assembly is at rest and stable. When the assembly is rotated to the position of FIG. 8, the center of gravity is to the left of flat wall and gravity automatically counter rotates the trainer back to the starting position.

The weights train a student to exert an increased force against the trainer in order to force the trainer to rotate, which encourages correct form for improved handsprings or walkovers.

Figure 13:
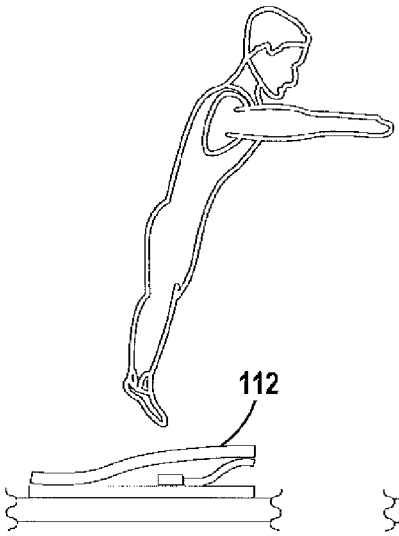
FIGS. 13 through 15 show use of the assembly for vaulting training.
Figure 14:
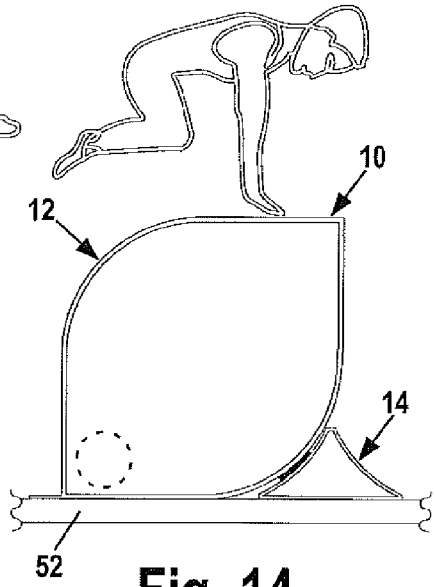
Figure 15:
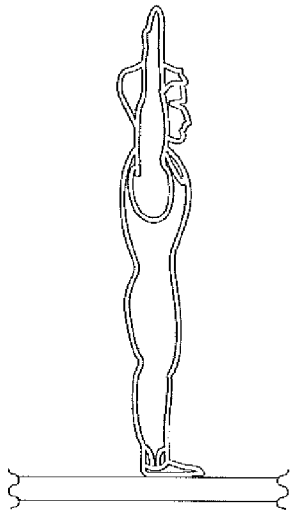

Training assembly 10 may also be used to train students to perform vaults, as illustrated in FIGS. 13, 14 and 15. The trainer 12 is held in carpet 52 when used for vaulting training. Trainer 12 is supported on the carpet and engages chock angled side 46. Fasteners 54, 56 and 60 secure the trainer and chock on the carpet and the trainer and chock together so that the trainer is stable and does not rotate during vaulting exercises.

FIG. 13 illustrates a student using a springboard 112 to vault above the trainer 12 which is fixed in place on the carpet. The student's hands engage supported trainer top wall 30 to permit push off and rotation to complete the vault as shown in FIG. 15.

While we have illustrated and described preferred embodiments of our invention, it is understood that this is capable of modification, and we therefore do not wish to be limited to the precise details set forth, but desire to avail ourselves of such changes and alterations as fall within the purview of the following claims.

We claim:

1. A gymnastic trainer assembly for teaching tumbling and vaulting on a support surface, the assembly including a pivot trainer and a chock; the pivot trainer having opposed sides, a top surface, a bottom surface, and a rounded pivot corner adjoining and extending above the bottom surface, the top surface, the bottom surface and the pivot corner located between said sides; the chock having a base, a top and a side extending from the base to the top; a first make-and-break fastener on the pivot trainer for forming a connection between the bottom surface of the pivot trainer and the support surface; and a second make-and-break fastener between the rounded pivot corner and the side of the chock for forming a connection between the chock and the pivot trainer; wherein the pivot trainer may be used to teach tumbling when free of the chock and the support surface, and the pivot trainer may be used to teach vaulting when secured to the support surface and to the chock by the fasteners.

2. The assembly as in claim 1 wherein each fastener includes a hook member.

3. The trainer as in claim 2 wherein the side of the chock adjacent the rounded pivot corner and the rounded pivot corner are complementary.

4. An assembly as in claim 1 wherein the pivot trainer includes a rounded surface across from the pivot corner, the rounded surface between the sides of the pivot trainer.

5. The assembly as in claim 4 wherein the pivot trainer includes a core formed from a resilient material and a covering surrounding the core.

6. The assembly as in claim 5 wherein said material is a polyurethane foam and the covering is vinyl material.

7. The assembly as in claim 1 including a counter balance weight in the pivot trainer, the weight located adjacent the support surface and away from the pivot corner.

8. The assembly as in claim 7 wherein the pivot trainer includes two opposed corners, the bottom surface extending from one of said opposed corners to the rounded pivot corner, the weight located adjacent the one opposed corner.

9. The assembly as in claim 1 including a flap joined to the pivot trainer, the flap having a first position extending away from the pivot trainer and overlying the support surface and a second position folded under the pivot trainer, and a make-and-break fastener to secure the flap to the support surface of the pivot trainer.

10. The assembly as in claim 1 wherein the pivot trainer has a height to width ratio of between about 0.72 and about 1.11.

11. The assembly as in claim 1 including a third make-and-break connection between the chock and the support surface.

12. A gymnastic trainer assembly for teaching tumbling and vaulting on a support surface, the assembly including a pivot trainer and a chock, the pivot trainer having a resilient core, opposed parallel sides, a top wall, a bottom wall, a front wall, a back wall, a first rounded corner between the front and bottom walls, a second rounded corner between the top and rear walls, the walls and corners extending between the sides of the trainer so that the trainer has a uniform vertical cross-section; the chock extending above the support surface; first make-and-break fastener means for removably securing the bottom of wall of the trainer to the support surface; second make-and-break fastener means for removably securing the chock to the support surface; and third make-and-break fastener means for removably securing the chock to the rounded corner of the pivot trainer; wherein when the chock is on the support surface and the trainer bottom wall is on the support surface with the first rounded corner adjacent the chock, the make-and-break fastener means hold the trainer and chock in place for vault training, and when the pivot trainer and chock are removed from the support surface, the trainer may be pivoted for tumbling training.

13. The assembly as in claim 12 wherein each make-and-break fastener means includes a fabric hook member.

14. The assembly as in claim 12 including a first counter rotation weight in the pivot trainer located adjacent the intersection of the bottom wall and the back wall.

15. The assembly as in claim 14 including a second counter rotation weight in the pivot trainer, each weight located adjacent one side of the pivot trainer.

16. The assembly as in claim 12 wherein the pivot trainer is symmetrical to either side of a plane through said rounded corners.

17. The assembly as in claim 12 wherein the pivot trainer has opposed sharp corners and is symmetrical to either side of a plane through said sharp corners.

18. The assembly as in claim 12 wherein the chock is triangular and includes a flat base on the support surface and two concave sides extending from the ends of the base to the top, one chock side facing the pivot corner, such side and the pivot corner being complementary.

* * * * *